United States Patent [19]

Bilbao-Eguiguren et al.

[11] Patent Number: 4,598,856

[45] Date of Patent: Jul. 8, 1986

[54] PROCESS FOR MAKING BIMETALLIC SEAMLESS TUBING OF STEEL OR SPECIAL ALLOYS FOR EXTRUSION

[76] Inventors: Jesua M. Bilbao-Eguiguren, Av. Savino Arana No. 17, Bilbao; Jose I. Garin de Lazcano, Carretera Yecora s/n., Oyon (Alava), both of Spain

[21] Appl. No.: 683,141

[22] Filed: Dec. 18, 1984

Related U.S. Application Data

[62] Division of Ser. No. 456,899, Jan. 10, 1983, abandoned.

[30] Foreign Application Priority Data

Jan. 14, 1982 [ES] Spain ..... 508733

[51] Int. Cl.[4] ..... B21C 23/22

[52] U.S. Cl. ..... 228/131; 228/155; 228/265; 72/258

[58] Field of Search ..... 72/256, 258, 267, 700; 228/126, 127, 131, 265, 155

[56] References Cited

U.S. PATENT DOCUMENTS

| | | | |
|---|---|---|---|
| 3,038,251 | 6/1962 | Mohnkern et al. | 228/265 |
| 3,648,351 | 3/1972 | Kibler | 72/258 |
| 4,015,765 | 4/1977 | Ahmed | 228/131 |
| 4,262,516 | 4/1981 | Weber et al. | 72/267 |
| 4,367,838 | 1/1983 | Yoshida | 72/258 |

*Primary Examiner*—Lowell A. Larson

*Attorney, Agent, or Firm*—Sheridan Neimark; Karl W. Flocks; Barry A. Edelberg

[57] ABSTRACT

A process of making round tubes covered on the inside with a sleeve of a thickness on the order of 20 to 30% of the total thickness of the tubes. The components of the tube consist of steel of strong mechanical characteristics and of an interior of stainless steel or a noble alloy. Both components are united by means of metallurgic cohesion, the result of which is a single tube, in effect. The making of the combined tube is achieved by reforming, piercing and extrusion at the same temperature.

5 Claims, 15 Drawing Figures

PROCESS FOR MAKING BIMETALLIC SEAMLESS TUBING OF STEEL OR SPECIAL ALLOYS FOR EXTRUSION

This is a division, of application Ser. No. 456,899 filed Jan. 10, 1983, now abandoned.

Within the oil drilling technique for the obtention of gas and petroleum, it becomes increasingly more necessary to produce these materials from reserves containing appreciable quantities of $H_2S$ and $CO_2$ and also using high temperatures which are eminently corrosive. As in the usual technique steel pipes are used, one reverts to the use of corrosion inhibitors which are applied so as to reduce the strong incidence and aggressiveness of these media where drilling is performed. However, these inhibitors are very costly and many times ineffective.

An evident solution to this high corrosion problem is the use of stainless steel pipes, nickel alloys and even titanium alloys. These products are excessively expensive and also require, on the other hand, a very special technique for their manufacture, which makes their cost prohibitive. Likewise, this type of materials can also be subject to different stress corrosion cracking which does not appear on conventional steel pipes. These factors maintain the existing problem and for the time being no relatively low cost pipes have been found providing a good performance against the above mentioned highly corroding environments.

Obviously, in view of this situation, users are thinking of employing bi-metallic pipes, based on an outer steel pipe and an internal steel lining or high quality alloys which may offer an alternative solution. This is why several techniques can be considered for the production of this type of pipes, all of them on an experimental basis such as co-extruding, mechanical assemblage, electrodepositing . . . etc.

In the co-extruding method, a fabricated pipe is put inside an outer steel one, thus obtaining an acceptable joining between the alloy lining and the outer pipe. A pipe sufficiently resistant for the aim in mind fabricated by this method is not known.

The linking or mechanical assemblage process means that an alloy pipe is put inside a steel pipe by any known means, and the ends are welded so that the corrosive environment will not get in touch with the contact surface between the internal lining and the outer pipe. This system's generally inherent problems are that even though general resistance is improved it is not known whether or not the connection between said liner and the pipe is sufficient.

In the electrodeposit technique, anti-corrosive material layers, nickel for example, are deposited with a relatively low cost, however, porosity problems appear and there is adequate linking between the outer pipe and the internal lining.

The U.S. Pat. No. 3,376,118 of ODENTHAL is also known, in which a metallic body is formed into a pipe. The compound metallic body is formed by an axially bored steel cylinder, in whose bore a special alloy material nucleus or core is laid out. The assembly is then subjected to the well-known rising hot piercing process, for later extruding, for example, as the per sizes of the desired pipe. Based on this system, internally lined steel pipes were obtained covered by a special steel or alloy lining.

For this type of compound metallic body, patent U.S. ODENTHAL U.S. Pat. No. 3,376,118 makes on the outer steel bore ingot, and one of its ends, a conical-frustrum shaped inlet, which was also translated into an end conical-frustrum protrusion on the special steel or alloy nucleus or core. This conical end of the body is where the drilling toll is put through, whose cross section should be smaller than the big base of the conical portion and bigger then the cross section of the core's circular portion. Likewise, there is also a metal disc provided on the base of the compound body opposite the end of penetration of the perforating tool.

Until now, the majority of these prior techniques used for obtaining a bi-metallic pipe with sufficient guarantee to be used in aggressive environments, present the substantial problem of a lack of an effective linking between the internal alloy liner and the outer steel pipe, which will guarantee the absence of application problems upon drilling in said aggressive environments.

With regard to what is described in U.S. Pat. No. 3,376,118, it is presently unknown what capacity and guarantee can be offered by the link between the material of the outer ingot and the special steel internal lining or alloy, on a final pipe made as per such procedure. However, the application of said bi-metallic body is mentioned, and its preparation made it necessary to perform an extreme manufacture of the raw material of the said bi-metallic body, as the axially bored ingot and the nucleus had to be prepared with very fine adjustments.

On the other hand, the cross diameter of the perforating tool should be smaller than the big diameter of the core's conical section, and bigger than the diameter of the core's cross section, and it was also highly necessary or at least very convenient, to weld a metallic disc onto the base opposite that where the drilling begins.

The invention which is introduced now is effected with much less time loss as the above, with an evidently lower cost in its preparation and a greater versatility on the perforator's useful diameter, as regards its relationship with the core's diameter, as well as concerns its relationship with the resistances of the materials that form the outer ingot and the core made of special steel or alloy.

For the proper preparation of a compound bimetallic body, as from which drilling is performed and a latter extruding operation, a simple square section steel billet is taken with its vertices rounded off with radii ranging from 40 to 45 mm., which is axially drilled when cold so as to constitute a totally cylindric internal longitudinal gap. The length of the billet that is used will vary between 750 and 980 mm.

Inside the cylindric gap made this way, a special steel or alloy solid cylinder is housed inside by means of a simple mechanical adjustment taking up the entire gap, and the ends of the assembly thus formed are sealed by welding.

As soon as this raw material has been assembled, same is put into an adequate press so as to be reformed. It is obvious that the billet's square section does not take up all the press body, before reforming, but free spaces are formed between the four faces of said billet and the internal cylindric surface of the interior of the press.

When the reforming operation takes place, these empty spaces are filled and the billet, together with the core, are turned into a cylindrical form which is secured to the sleeve of the press interior in any case, and at the same time a perfect link is obtained between all surfaces in touch with the billet and core, the first and basic stage for the final obtention of the metallurgic cohesion desired on the final billet. At the same time, the core's section varies in relation to the section of the drilling tool to be applied later as per the differences there may well be between the material's hot deformation resistance of the supporting ingot and the core or lining material, also in function of the final pipe lining thickness which is to be attained.

The latter operation on an assembly thus formed includes hot perforation or "rising hot piercing" on which some remarks should be made, such as the useful diameter of the piercing tool, deformation resistance of both hot component materials . . . etc., etc. With regard to piercing temperature deformation resistance, the fact is that the maximum relationship between both should 2.5 to 1, as per the qualities of the materials to be used in each particular case.

The maximum admissible piercing ratio as per the invention would 10 to 1, understanding as such, the relation between the length of the pierced billet and the diameter of the piercing tool.

With regard to the diameter of the piercing tool, same will present a fluctuation value between 60 and 300 mm in fuction of the capacity of the press. The section ratio between said piercing tool and the special steel or alloy core, after the reformation process, corresponds to the difference in deformation resistance of both steels, sleeve and lining. The tool's diameter may well be equal, bigger or smaller than the core's diameter, once reformed, and could even become smaller than the core's diameter prior to being reformed, all of this with no sort of limitation whatsoever, with the logical dependence of the lining thickness which is to be obtained with the core's material.

There are, therefore, big possibilities of use of different piercing tool diameters, so that the bi-metallic body with a special steel or alloy internal lining obtained after the "rising hot piercing" operation presents an adequate and sufficient metallurgic cohesion between both the materials it is formed of, and can be treated later on by extrusion until a final pipe is produced with an outer steel one and an internal lining made of special steel or alloy, which satisfactorily fulfils the foreseen aims.

The thicknesses of the final bi-metallic pipe, as regards its internal component, shall at least approximately be 1 mm or 10 percent of the pipe's thickness, and at the most 50 percent the thickness of the already-extruded pipe. Dimensions on the outer diameter will be between 1" and 3⅝", with metallic extruded pipe thicknesses between 3 and 60 mm.

An example of the invention and its antecedents is shown on the enclosed drawings:

FIGS. 1, 2, and 3 show how the process is done as per ODENTHAL.

Figure 8:
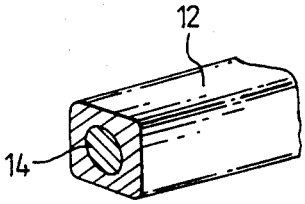
FIG. 8 shows the cojunction of billet and core, as per the invention.
Figure 9:
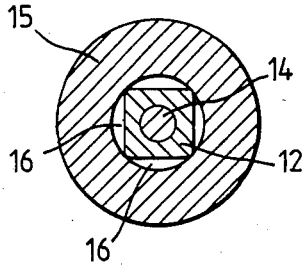

FIG. 9 belongs to a cross section of the contents of FIG. 8 inside the interior of the reforming press and before said operation is effected.

Figure 10:
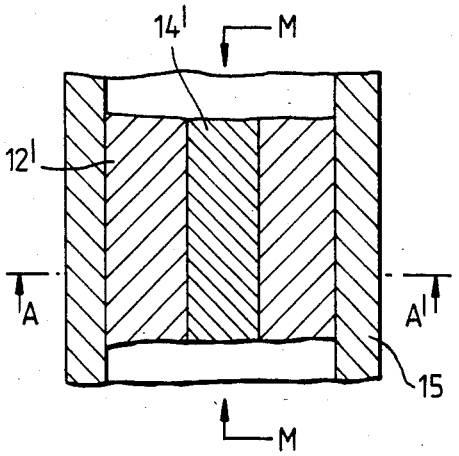

FIG. 10 is a side view of the above assembly once reformed.

Figure 11:
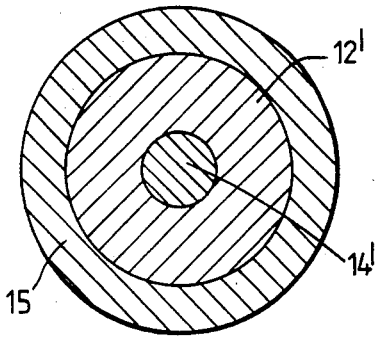

FIG. 11 is a section "A" of the above.

Figure 12:
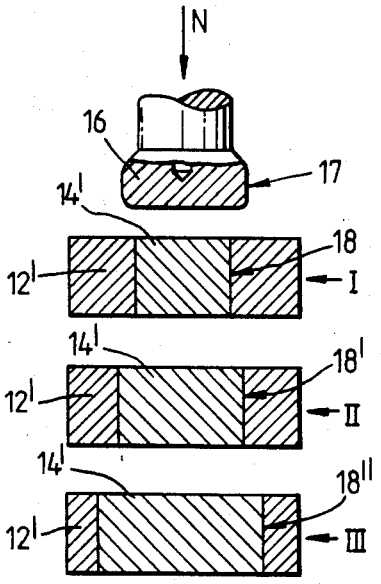

FIG. 12 is an explicative figure of the several possibilities of the tool's section in relation with the core's section after reforming.

Figure 13:
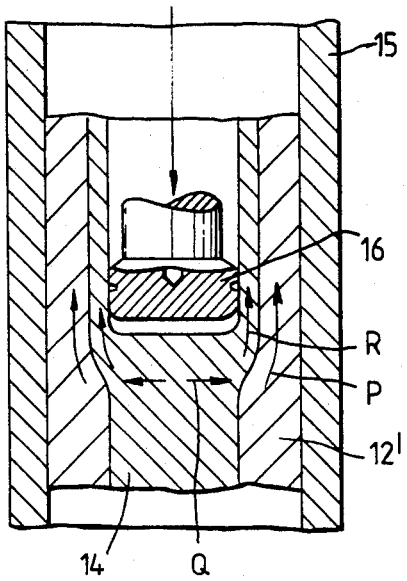

FIG. 13 shows the glide and creep lines of both materials throughout the piercing operation.

Figure 14:
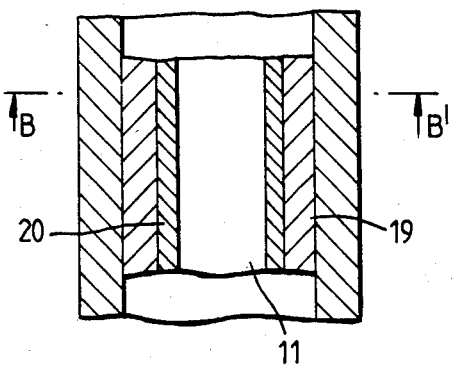

FIG. 14 is a partial side view of the bi-metallic body after piercing as per FIG. 13.

Figure 15:
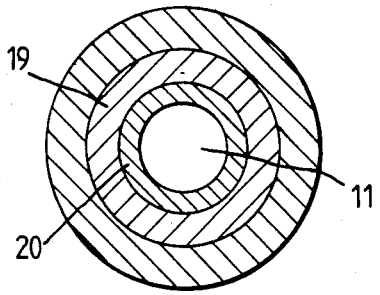

FIG. 15 is section BB' of the above.

Figure 2:
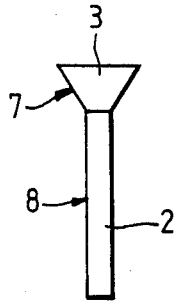
Figure 3:
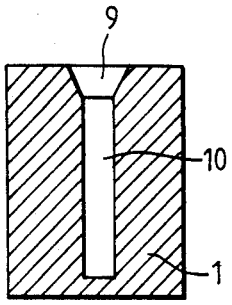

The form of executing U.S. Pat. No. 3,376,118 ODENTHAL is shown on FIGS. 1, 2 and 3 where a steel cylindric (1) ingot is used, with orifices inside (10) and with a conical frustrum (9) inlet at one of its ends. On FIG. 2, the core's (2) constitutive element can be seen which will later on have to be housed within orifice (9) - (10) of the ingot (1). Core (2) will have a special outer shape (7) - (8) which shall fit into the ingot's (1) gap (9) - (10). Afterwards, (2) - (3) are put into (9) - (10) of ingot (1) and then pierced with a tool of a diameter smaller than the portion's (4) big base (FIG. 1) and bigger than the section of portion (2) (FIG. 1).

In constrast to the complexity of the above mentioned method, the object of the invention starts from the billet (12), drilled on the back to form a bore (13) and with the bore occupied by the cylindric nucleus (14) of special steel or alloy, which takes up the entire bore (13) of the billet (12) as shown in FIG. 8. This material thus prepared is housed within the interior of a perforating and reforming press (15) (FIG. 9).

Figure 1:
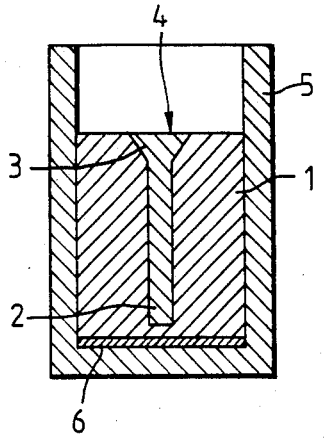

This is where the reforming operation is begun (FIG. 10) and why the spaces (16) shown on FIG. 9 between the billet's lateral faces (12) and the internal wall of the press container are filled in (15) until the section of FIG. 1 is attained which is when the entire internal surface of the press container (15) is fully occupied, thus achieving a perfect coupling between all the surfaces in touch with the billet (12) and core (14).

Figure 4:
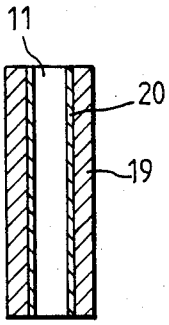
FIG. 4 is a bi-metallic body, prior to being extruded.
Figure 5:
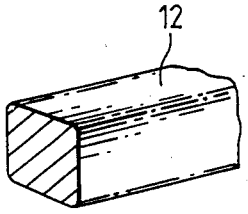
FIG. 5 shows the billet used as a basis, as per this invention.
Figure 6:
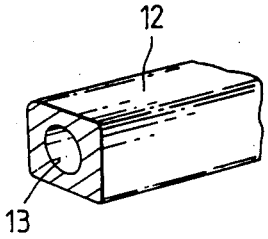
FIG. 6 shows billet preparation which is cold axially pierced as per the invention.
Figure 7:
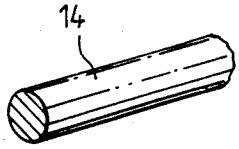
FIG. 7 is the special steel or alloy cylinder which constitutes the core as per the invention.

The bi-metallic body obtained thus is then pierced in the reforming press (FIG. 12) with a tool (16) whose outer diameter (17) can be small - item III - alike - item II, or bigger - Item I than the pertinent average diameters of the reformed core's (14') cross sections until the body shown on FIG. 4 is constituted with an exterior (19) of supporting steel, an internal lining (20) made of special steel or alloy, and an internal gap (11) liable to constitute later on a bi-metallic pipe upon applying an extruding process to same for said purpose.

FIG. 12 illustrates the procedure's versatility which is mentioned above and it is clearly seen how in Item I, the piercing tool's (16) diameter (17) is bigger than the diameter of the already reformed core's (14) cross section. As regards Item II, the diameter of the piercing tool (16) is equal to diameter (18') of the already reformed core's (14') cross section. Finally and referring to Item III, we can see how diameter (17) of the tool (16) is smaller than diameter (18'') of the core's (14') cross section after being reformed. All of it as per the deformation resistance differences of both steels and the lining splendour that is to be attained later on with the final extruded pipe.

We claim:

1. A method of making a compound metallic cylindrical body comprising the steps of:

providing a steel billet having a square exterior cross-section and an axial circular cross-sectioned bore therein;

filling the entirety of said axial bore with a corrosion-resistant alloy to form a filled steel billet;

placing said filled steel billet into a cylindrical cavity defining the interior of a press;

applying radially inwardly directed pressure against the entire exterior surface of said filled steel billet within said cylindrical cavity to reform the square cross-section of said filled steel billet into a circular exterior cross-section;

subjecting the filled bore of the filled steel billet having a cylindrical exterior cross-section to rising hot piercing using a piercing tool having a diameter which is larger, smaller or equal to the diameter of said filled bore to form said compound metallic cylindrical body.

2. A method according to claim 1, wherein the billet has a length of between 750 and 980 mm.

3. A method as per claim 1, wherein the ratio between the length of the pierced billet and the diameter of the piercing tool is no greater than 10 to 1.

4. A method as per claim 1, wherein the maximum ratio between deformation resistances, at piercing temperature, of both components is 2.5 to 1.

5. The method of claim 1, wherein hot piercing step is accomplished using a piercing tool having a diameter larger than the diameter of said filled bore.

* * * * *